United States Patent [19]

Chow

[11] Patent Number: 4,645,979

[45] Date of Patent: Feb. 24, 1987

[54] DISPLAY DEVICE WITH DISCHARGE LAMP

[76] Inventor: Shing C. Chow, 12A Suffork Road, Kowloon, Hong Kong

[21] Appl. No.: 582,623

[22] Filed: Feb. 22, 1984

[30] Foreign Application Priority Data

Aug. 21, 1981 [JPX] Japan ..... 56-131801

[51] Int. Cl.[4] ..... G09G 3/10; H01J 61/06

[52] U.S. Cl. ..... 315/169.1; 315/DIG. 4; 315/DIG. 5; 315/219; 313/607; 313/558; 313/493

[58] Field of Search ..... 315/DIG. 5, 219, 169.1, 315/DIG. 4; 313/607, 558, 486, 493

[56] References Cited

U.S. PATENT DOCUMENTS

| | | | |
|---|---|---|---|
| 2,068,741 | 1/1937 | Geffken et al. | 313/607 |
| 2,994,012 | 7/1961 | Negrete | 315/219 |
| 3,727,089 | 4/1973 | Chow | 313/558 |
| 3,882,357 | 5/1975 | Nieuweboer et al. | 315/219 |
| 3,988,633 | 10/1976 | Shurgan et al. | 313/493 |
| 4,009,416 | 2/1977 | Lowther | 315/219 |
| 4,246,515 | 1/1981 | Schauffele | 315/219 |
| 4,461,978 | 6/1984 | Mikoshiba et al. | 315/169.4 |
| 4,492,899 | 1/1985 | Martin | 315/219 |
| 4,529,913 | 7/1985 | Brosillon | 315/DIG. 4 |

FOREIGN PATENT DOCUMENTS

| | | | |
|---|---|---|---|
| 2610944 | 9/1977 | Fed. Rep. of Germany | 315/219 |
| 0138854 | 10/1981 | Japan | 313/486 |

*Primary Examiner*—David K. Moore
*Assistant Examiner*—M. Razavi
*Attorney, Agent, or Firm*—Dennison, Meserole, Pollack & Scheiner

[57] ABSTRACT

Disclosed herein is a discharge lamp type display device which comprises mainly at least one discharge lamp formed by a discharge tube in which inert gas is charged. The discharge lamp comprises a pair of electrodes one of which is locally provided within the discharge tube adjacent one end thereof and the other is formed of electrically conductive, light transmissive film deposited on the exterior surface of the discharge tube. The display device further comprises means for gradually increasing or decreasing the voltage or the frequency of discharge power to be supplied between the two electrodes of the discharge lamp, whereby illumination region of the discharge lamp is variably controlled.

1 Claim, 16 Drawing Figures

DISPLAY DEVICE WITH DISCHARGE LAMP

BACKGROUND OF THE INVENTION

1. Field of the Invention

The present invention relates to a display device, and more particularly to a display device with a discharge lamp in which the illumination region of the discharge lamp may vary with varying voltage or frequency of discharge power to be supplied to the discharge lamp so as to display information with dynamic effect.

2. Description of the Prior Art

U.S. patent application Ser. No. 299,613 filed by the applicant of the present invention discloses a discharge lamp formed by a glass tube which serves as a dielectric body and having a pair of electrodes one of which is provided within the glass tube and the other is outside of the glass tube. The discharge lamp can be activated for luminous discharge by relatively low power supply having the voltage peak of hundreds of volts and the frequency between several and tens kHz. Thus, such a discharge lamp has made it possible to provide a display device which is compact in size and light in weight and suitable for displaying characters, numerals, symbols, etc. In the above prior art display system, specific information can be blinked, for example, by supplying discharge power to the discharge lamp intermittently at every given period of time so that the information may be distinct from others. Such a system, however, blinks the discharge lamp itself at every given period of time and cannot directly create a dynamic effect on the information by a single discharge lamp. Such a dynamic effect may be created on the information, for example, by employing a number of discharge lamps arranged in series which are flashed sequentially one by one. This system will, however, require a specific timing control circuit to supply discharge power for flashing the individual discharge lamp at a given time, leading to a large-sized construction of the overall system. This disadvantage will remarkably spoil facility of this type of the display device of the prior art.

SUMMARY OF THE INVENTION

Accordingly, it is the primary object of the present invention to provide a display device which can create a dynamic effect on the information to be displayed by using a discharge lamp which is a modification of the one disclosed in U.S. patent application Ser. No. 299,613.

The discharge lamp of the present invention is formed by a discharge tube and has a pair of electrodes between which the discharge path is formed. The electrodes are quite different in size from each other, for example, one of them is locally provided in the vicinity of the end of the discharge tube and the other is formed along the exterior surface of the tube in the longitudinal direction thereof. Further, the electrodes function in a similar manner as capacitors do, as an inert gas and a dielectric discharge tube are interposed between the electrodes.

With this capacitive arrangement between the electrodes, or in other words, with the construction in which electric field intensity to be applied to the charged gas is gradually varied with the distance between the electrodes, the illumination region of the discharge lamp itself can be changed by varying, for example, the voltage level of the discharge power to be supplied to the electrodes to create a dynamic effect on the information to be displayed. As the illumination region of the discharge lamp is increased or decreased responsive to the voltage level to be supplied to the electrodes, the display device according to the present invention can be used as a level meter or a display means in which various information may be transmitted in terms of magnitude of displayed length.

When the illumination region of the discharge lamp thus constructed is controlled to be gradually varied along the longitudinal direction of the tube, the luminance in the illumination region is apt to be gradually reduced with varying distance from the electrode within the discharge tube. For this reason, the luminance distribution in the information cannot be uniform, causing uneven coloring. Such a discharge lamp has a further defect that the discharge tube wall becomes blackened within a short period of time through evaporation of the electrode within the discharge tube due to high temperature at the top end thereof, resulting in reduced life of the discharge lamp.

In order to remedy the above defects, the discharge lamp of the present invention has a getter attached to the extreme end of the electrode within the discharge tube and formed of known titanium, tantalum or zirconium which is highly effective to absorb a harmful discharged substance such as harmful gas or impurity. The getter encloses the extreme end of the electrode in such a way as to project from the electrode in the longitudinal direction of the tube, thereby restricting the discharge path formed during luminous discharge of the discharge lamp.

The discharge lamp thus constructed is quite effective to remarkably increase the luminance in the whole illumination region than the prior art discharge lamp and further to prolong the discharge path, as the ions emitted from the electrode within the discharge tube receives multiplication action of secondary emission when passing through the getter. Thus, this type of the discharge lamp is quite advantageously applicable to display means.

The invention will become more apparent from the claims and the description as it proceeds in connection with the drawings.

DETAILED DESCRIPTION OF PREFERRED EMBODIMENTS

In the following description, reference will be made to a discharge lamp which is relatively small in size, having, for example, a diameter approximately 2 to 10 mm and a length approximately 10 to 100 mm, but any other discharge lamp which is large in diameter and length may be employed substantially in the same way.

Figure 1:
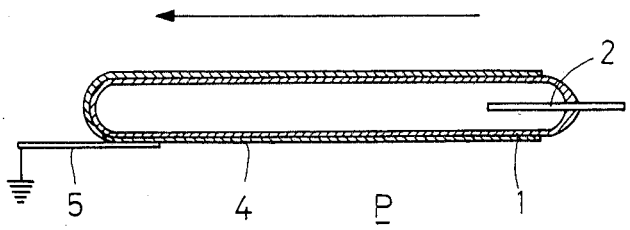
FIG. 1 is a cross sectional view of an embodiment of a discharge lamp for use in the present invention.
Figure 2:
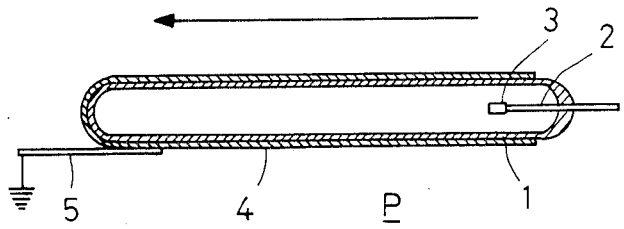
FIG. 2 is a cross sectional view of another embodiment of the discharge lamp.
Figure 3:
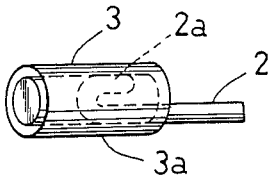
FIG. 3 is a perspective view of the essential parts of FIG. 2.
Figure 4A:
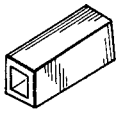
FIG. 4 is a perspective view of variant forms of getters for use in the discharge lamp.
Figure 4C:
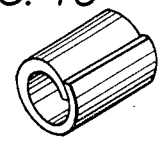
Figure 4E:
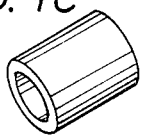
Figure 4B:
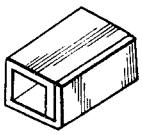
Figure 4D:
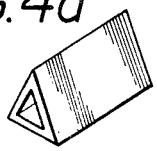

Referring now to FIG. 1, there is shown a discharge lamp P having a discharge tube 1 which is made of soft glass such as transparent soda glass, or hard glass such as borosilicate glass in a straight shape as shown in the drawing. The discharge tube 1 contains an inert gas such as neon and xenon at a pressure from several to hundreds mmHg. The discharge lamp P has a linear electrode 2 provided locally within the discharge tube 1 adjacent one end thereof, as shown in the drawing. In case the discharge tube 1 is made of soft glass, Dumet wire is preferably used for the electrode 2; in case of hard glass, a tungsten wire is preferably used. FIG. 2 shows another embodiment of the discharge lamp P wherein the electrode 2 has a getter 3 attached to and projecting from the extreme end of the electrode 2. The getter 3 is employed to lengthen the life of the discharge lamp P and may be formed of titanium, tantalum or zirconium which is highly effective to absorb a harmful discharged substance such as harmful gas or impurity. The getter 3 is a hollow cylindrical member as shown in FIG. 3. The electrode 2 has a U-shaped end 2*a* on which the getter 3 is fitted through the hollow portion thereof to be fixed at the end 3*a* thereof onto the end of the electrode 2 by pressure welding or spot welding. In this specific mounting of the getter 3 on the electrode 2, the end 2*a* of the electrode 2 is encircled by the getter 3. Another electrode 4 is provided outside of the discharge lamp P over the length of the discharge tube 1, and a discharge path is formed between the electrodes 2 and 4 through the hollow portion of the getter 3. The electrode 4 is formed by spraying an aqueous solution such as of tin halide under atomized condition onto the exterior surface of the discharge tube 1 heated at 500° to 700° C., to thereby coat the surface with electrically conductive film, for example, of tin oxide through which discharge light may transmit. Further, in order to improve luminous discharge a fluorescent film may be coated on the inner surface of the discharge tube 1, thereby blocking the internal electrode 2. The color of the fluorescent film may preferably be silver or gold. An electrically conductive wire 5 is connected to the electrode 4 and serves to supply power to the discharge lamp P.

FIG. 4 shows various types (a)–(e) of the getter 3 to be attached to the end 2*a* of the electrode 2. Types (a) and (b) are tubular members each having a rectangular section; type (c) is a cylindrical member; type (d) is a tubular member having a triangular section; and type (e) is a tubular member having an elliptic section. Types (a), (d) and (e) may be made of a sheet material in the same way as types (b) and (c).

Figure 5:
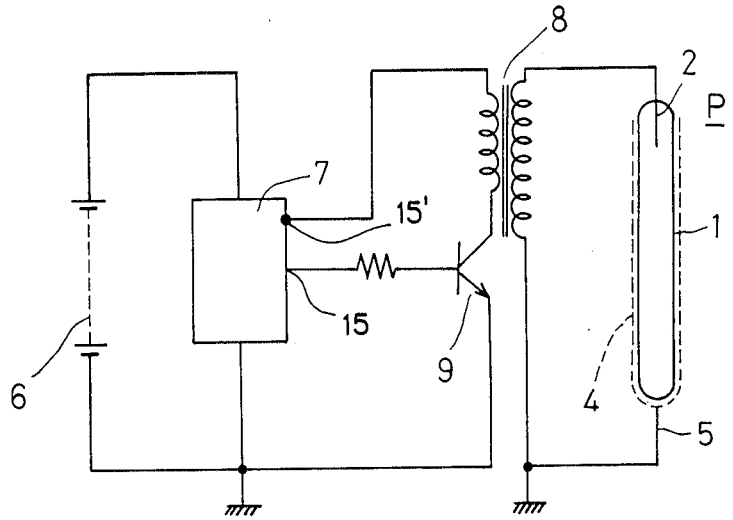
FIGS. 5 and 6 are schematic diagrams of circuit to activate the discharge lamp for luminous discharge.

FIG. 5 shows a schematic diagram of the circuit for energizing the discharge lamp P shown in FIGS. 1 or 2. A power supply 6 is provided to supply a DC low voltage of several volts, for example, about 3 to 12 V through a control signal generator 7 and a primary winding of a boosting transformer 8 to a transistor 9. The control signal generator 7 is adapted to generate a control signal which serves as a driving signal for the discharge lamp P such as a pulse signal having a frequency of hundreds Hz, for example 300 Hz to 20 kHz. The control signal generator 7 has an output terminal 15 connected to the transistor 9 through a resistance and has another output terminal 15 connected to the boosting transformer 8. The boosting transformer 8 serves to boost the voltage of the control signal to sufficient magnitude to light up the discharge lamp P, creating at the secondary winding thereof a pulse voltage, for example, about 500 to 1200 V at the peak.

Figure 6:
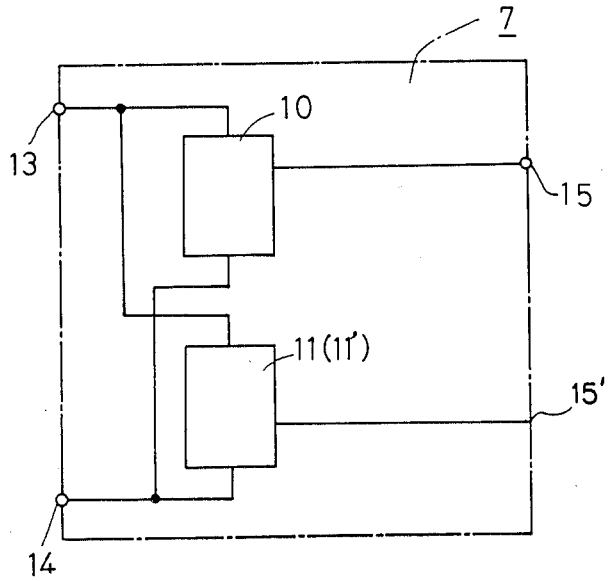
Figure 7:
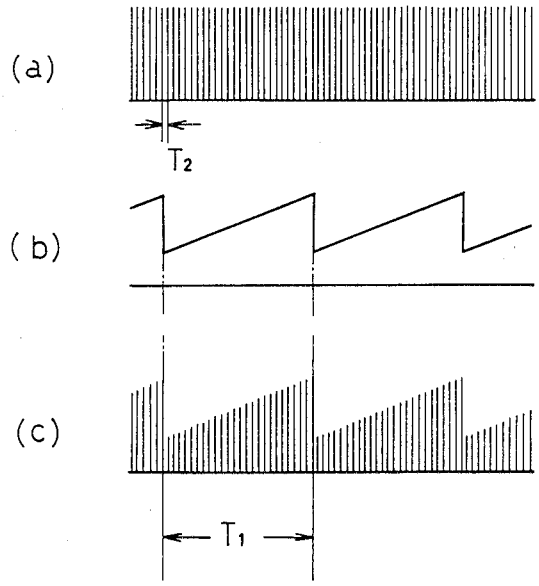
FIG. 7 is a group of output waveform diagrams illustrating in detail the control signal or driving signal developed in the circuit shown by FIG. 6.

FIG. 6 shows a schematic diagram of the circuit of the control signal generator 7. The control signal generator 7 is adapted to generate control signals or driving signals which serve to gradually increase or decrease the voltage of the discharge power to be supplied to the discharge lamp P to continuously variably control the length of the discharge path that is the illumination region of the discharge lamp P. A pulse signal generator 10 is provided to generate pulse signals having hundreds Hz to several kHz, as shown in FIG. 7(*a*). Further, a sawtooth signal generator 11 is provided to generate sawtooth waveform signals having about a fraction of 1 Hz to several Hz as shown in FIG. 7(*b*). The output signals shown in FIG. 7 (c) are fed to the primary winding of the boosting transformer 8. In FIG. 6, input terminals 13 and 14 are power input terminals connected to the power supply 6 in FIG. 5, and an output terminal 15 is a control signal output terminal connected to the transistor 9 in FIG. 5. The output terminal 15 is a controlled signal output terminal connected to the transistor 9 in FIG. 5, and the output terminal 15' is a sawtooth waveform signal output terminal connected to the boosting transformer 8 in FIG. 5.

Figure 8:
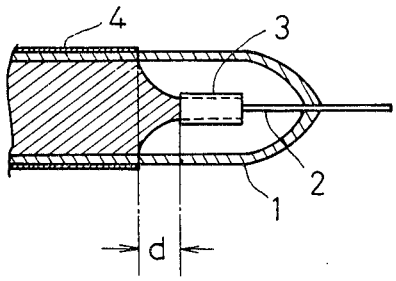
FIG. 8 is a fragmentary cross sectional view of the discharge lamp, illustrating the operating condition of the discharge lamp.

FIG. 8 shows the discharge lamp P being excited for illumination in which the getter 3 is attached to the free end of the electrode 2, projecting from the electrode 2 in the longitudinal direction of the tube and the electrically conductive film 4 is formed on the exterior surface of the discharge tube 1 except the part encircling the end of the electrode 2 provided in the discharge tube 1, as shown in the drawing. Illumination region is illustrated by shade line in the drawing. The electrically conductive film 4 may preferably extend over the whole length of the discharge tube 1 except a part of the end encircling the electrode 2 with a predetermined longitudinal distance d away from the getter 3. Experiment shows that the distance d changes with the tube length and that the appropriate range is 2 to 10 mm.

Figure 9:
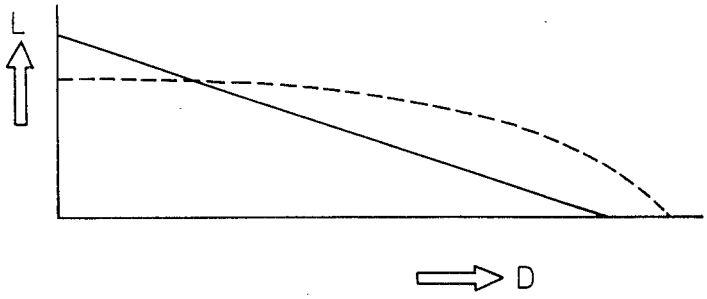
FIG. 9 is a diagram illustrating the oprating condition of the discharge lamp.

FIG. 9 shows a luminance distribution in the illumination region created by luminous discharge of the discharge lamp P, in which the abscissa indicates the distance D of the illumination region in the longitudinal direction of the tube, and the ordinate indicates the luminance L. The solid line in the drawing shows the state of the luminance distribution of the prior art discharge lamp, while the dotted line shows that of the discharge lamp P according to the present invention.

Figure 10:
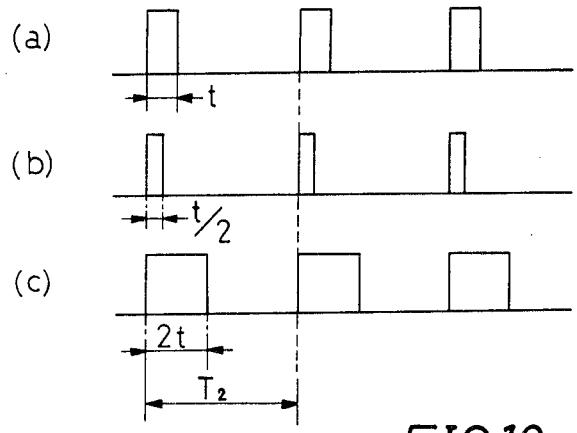
FIG. 10 is a group of pulse waveform diagrams illustrating the control signal or driving signal.

FIG. 10 shows in detail the output signal waveforms (a)–(c) of the pulse signal (see FIG. 7(*a*)) generated at every period of $T_2$ which is the control signal transmitted from the pulse signal generator 10 in FIG. 6. When the pulse width t of the pulse signal in FIG. 10(*a*) is reduced to half, namely t/2 as shown in FIG. 10(*b*), the luminance of the discharge lamp P is decreased to save energy. On the contrary when the pulse width t of the pulse signal in FIG. 10(*d*) is doubled to obtain a pulse signal having a width of 2t as shown in FIG. 10(*c*), the luminance of the discharge lamp P is inceased.

Figure 11:
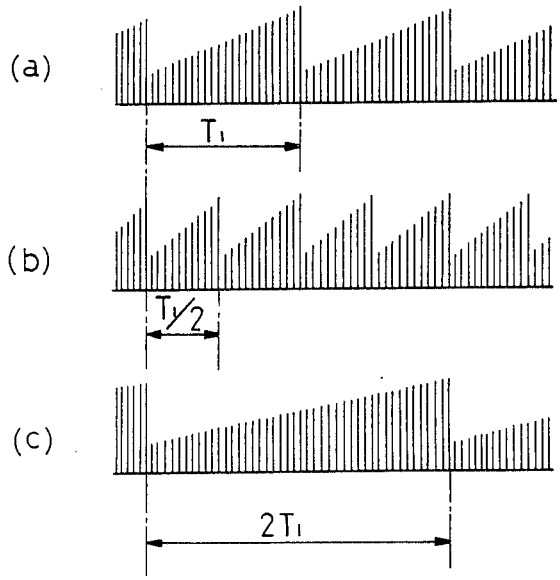
FIG. 11 is a group of output signal waveform diagrams in which the period of the control signal (C) shown in FIG. 7 is changed.

FIG. 11 shows in detail the waveforms (a)–(c) of the control signal generated by the control signal generator 7 in FIG. 6 (see FIG. 7(*c*)). When the period $T_1$ in FIG. 11(*a*) of the control signal that serves as the driving signal is reduced to half, namely $T_1/2$ as shown in FIG. 11(*b*), the illumination region of the discharge lamp P is controlled to be continuously varied in a shorter period. On the contrary when the period $T_1$ of the control signal in FIG. 11(*a*) is doubled to obtain an output signal having the period of $2T_1$ as shown in FIG. 11(*c*), the illumination region of the discharge lamp P is controlled to be continuously varied in a longer period.

Figure 12:
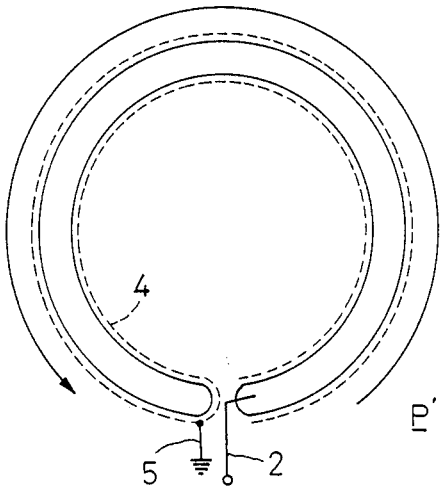
FIGS. 12 to 15 show different arrangement of the display lamps for displaying various information.

FIG. 12 shows another form of the discharge lamp P′ having a curved tube, the illumination region of which continuously changes along the curved line in the direction of arrow in the drawing, while in the discharge lamp P illustrated by FIGS. 1 or 2, the illumination region continuously changes straightly in the direction of the arrow in the drawing in response to the control signal. Except the curved tube, the discharge lamp P′ has essentially the same construction as the discharge lamp P in FIG. 1.

Figure 13:
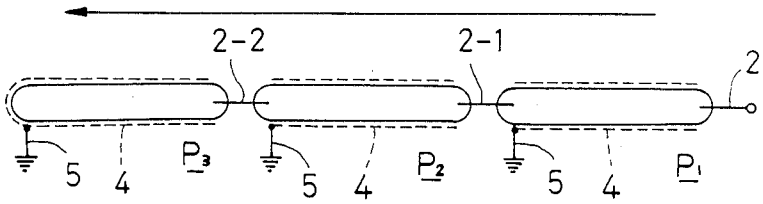

In FIG. 13, three straight discharge lamps $P_1$, $P_2$ and $P_3$ are connected in series so as to have substantially the same effect as the discharge lamp P in FIGS. 1 or 2. Electrodes 2-1 and 2-2 are interposed respectively between the discharge lamps $P_1$ and $P_2$ and between the discharge lamps $P_2$ and $P_3$ as shown in the drawing.

Figure 14:
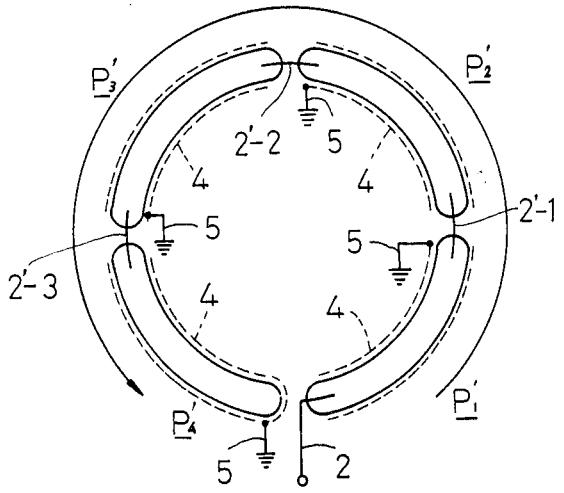

In FIG. 14, four curved discharge lamps $P'_1$, $P'_2$, $P'_3$ and $P'_4$ are connected in series so as to have substantially the same effect as the discharge lamp P′ in FIG. 12. Electrodes 2′-1, 2′-2 and 2′-3 are interposed respectively between the lamps $P'_1$ and $P'_2$, between the lamps $P'_2$ and $P'_3$ and between lamps $P'_3$ and $P'_4$, as shown in the drawing.

Figure 15:
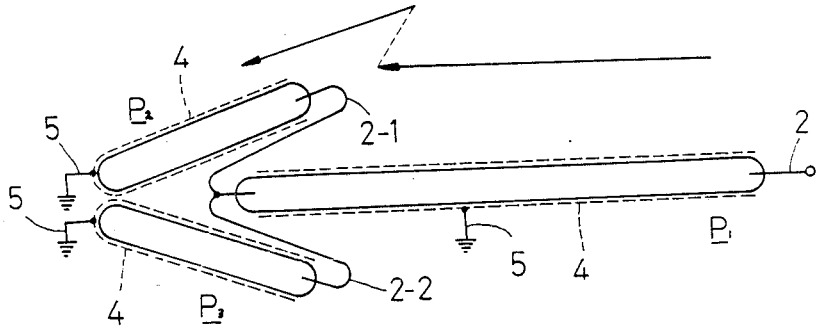

In FIG. 15, three straight discharge lamps $P_1$, $P_2$ and $P_3$ are connected in series-parallel combinations so as to exhibit a dynamic effect on the information to be displayed, that is the arrow symbol arranged by the three lamps $P_1$, $P_2$ and $P_3$. Electrodes 2-1 and 2-2 are interposed respectively between the discharge lamps $P_1$ and $P_2$ and between the discharge lamps $P_1$ and $P_3$ as shown in the drawing.

Figure 16:
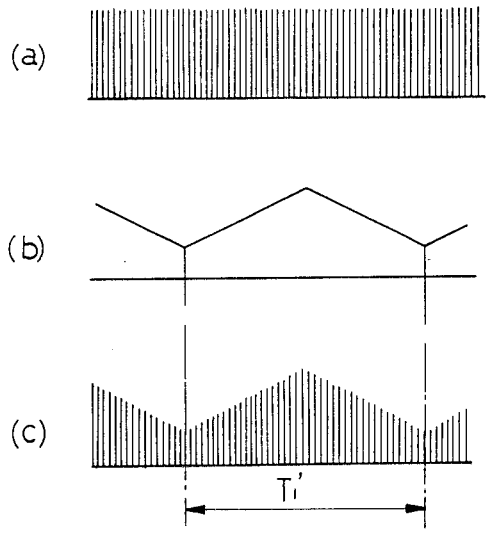
FIG. 16 is a group of output signal waveform diagrams illustrating a control signal different from that (C) in FIG. 7.

FIG. 16 shows various waveforms (a) - (c) of control signals for controlling the illumination region of the discharge lamp P or P′ to be continuously increased and decreased, by employing a triangular pulse signal generator 11′ in place of the sawtooth waveform signal generator 11 in FIG. 6. Waveform (a) shows the pulse signal waveform from the pulse signal generator 10 in FIG. 6; waveform (b) shows the triangular pulse waveform generated at every period of $T_1'$ by the triangular pulse signal generator 11′; and waveform (c) shows the control signal waveform generated from the AND gate 12 in FIG. 6.

Figure 17:
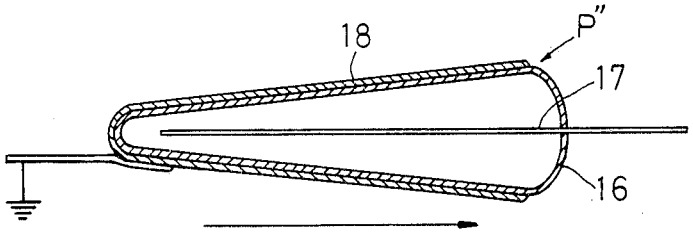
FIGS. 17 and 18 are cross sectional views of discharge lamps according to alternative embodiments of the present invention.
Figure 18:
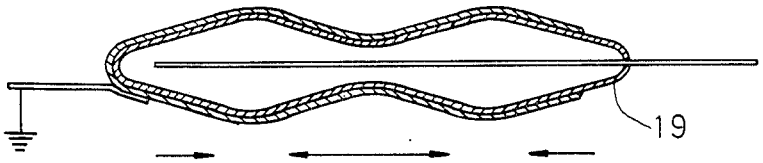

FIG. 17 shows a discharge lamp P″ having a conical discharge tube 16 whose diameter is longitudinally varied. The discharge tube 16 has a linear electode extending along the axis thereof, and an electrically conductive film 18 formed on the exterior surface thereof. Thus constructed, the distance between the electrodes 17 and 18 is gradually changed in the longitudinal direction of the discharge tube 16. The discharge tube 16 may be of any other desired configuration, for example the corrugated discharge tube 19 as shown in FIG. 18.

Now the operation of the display device thus constructed will be described. When the electrodes 2 and 4 of the discharge lamp P in FIGS. 1 or 2 are connected to the secondary winding of the boosting transformer 8 as shown in FIG. 5, and the control signal in FIG. 7(*c*) generated by the control signal generator 7 is supplied through the transistor 9 to the primary winding of the boosting transformer 8, the pulse voltage whose peak level gradually increases in the period of $T_1$ is applied across the electrodes 2 and 4. As the discharge lamp P in FIGS. 1 and 2 includes an inert gas such as neon and xenon, and a dielectric glass member interposed between the electrodes 2 and 4, the increasing level of the applied voltage, namely the increasing electric field intensity causes the illumination region of the discharge lamp P to be continuously extended. In other words, the discharge path of the discharge lamp P is gradually prolonged in the period of $T_1$ in the direction of the arrow from right to left in FIGS. 1 and 2 in response to the control signal.

As the getter 3 is mounted onto the electrode 2 in such a way as to project therefrom in the longitudinal direction of the tube, encircling the free end 2*a* of the electrode 2, as shown in FIG. 3, ions emitted from the electrode 2 toward the electrically conductive film 4 is restricted by the internal wall of the getter 3. Thus constructed, the illumination region of the discharge lamp P can be restricted as shown by the shadowed portion in FIG. 8. Furthermore, according to the present discharge lamp, local heating of the electrode itself can be reduced to significantly prevent a known blackening of the tube wall, quite advantageously resulting in prolonged life of the discharge lamp P itself.

In the discharge lamp according to the present invention, emission of ions in the cylinder of the getter 3 is remarkably promoted through multiplication action. Further, the specific construction of the getter 3 restricts the direction of emission. The electrically conductive film 4 is formed all over the exterior surface of the tube except the end surface portion as shown in FIG. 7. Thanks to these features, the discharge path or the illumination region is greatly increased with the identical magnitude of energy as applied in a discharge lamp without the getter and furthermore, unevenness of luminance can be greatly reduced. These operational effects can be varied as desired through the configuration of the getter 3, for example the ones shown in FIG. 4(*a*)–(*e*), the radius and the length of the getter 3 projecting from the electrode 2 in the longitudinal direction of the tube, the distance d in FIG. 7 between the electrodes 2 and 4 in the longitudinal direction of the tube, and other parameters.

Thus, the discharge lamp according to the present invention is practically useful, because of the getter being mounted on the free end of the electrode and effective to prevent blackening of the tube wall and unevenness of luminance in the discharge path and, furthermore, to remarkably increase the discharge path itself.

The above description refers to the discharge lamp in which gradually increasing or decreasing voltage is applied across the electrodes; however, as the electrodes are capacitively coupled, frequency of the discharge power to be supplied to the electrodes may be increased or decreased to permit the discharge lamp to operate in the same way as discussed in the preceeding paragraphs.

When the discharging lamp P' shown in FIG. 12 is connected to the circuit in FIG. 5, the illumination region of the discharge lamp P' is continuously increased in response to the level of voltage applied across the electrodes 2 and 4. The discharge path of the discharge lamp P' is continuously prolonged in a given period of time in such a way as to draw a circle.

When the three discharge lamps $P_1$, $P_2$ and $P_3$ in FIG. 13 are connected in series with the circuit in FIG. 5, first, the discharge path of the discharge lamp $P_1$ is straightly prolonged in response to the increase of the level of voltage applied across the electrodes 2 and 4. After the discharge path of the discharge lamp $P_1$ is completed, the discharge path of the second discharge lamp $P_2$ begins to extend straightly from the electrode 2-1 to the electrode 2-2, and finally after the two discharge paths are completed, a new discharge path is formed in the third discharge lamp $P_3$. Thus, a series of discharge lamps $P_1$, $P_2$ and $P_3$ can give substantially the same operational effect as the single discharge lamp as shown in FIGS. 1 and 2.

In case of the four curved discharge lamps $P'_1$, $P'_2$, $P'_3$ and $P'_4$ connected in series as shown in FIG. 14, the discharge lamps $P'_1$, $P'_2$, $P'_3$ and $P'_4$ gradually illuminate in response to the increasing voltage of the discharge power supplied to the electrodes 2 and 4 just in the same way as the case in FIG. 13. The discharge path extends along the tubes of the discharge lamps $P'_1$, $P'_2$, $P'_3$ and $P'_4$ in the direction of the arrow to draw a circle, and can create substantially the same operational effect as the single lamp P' in FIG. 12.

In case of the three straight discharge lamps $P_1$, $P_2$ and $P_3$ connected in series-parallel combinations as shown in FIG. 15, the discharge lamp $P_1$ first illuminates and then the other two discharge lamps $P_2$ and $P_3$ illuminate at the same time responsive to the increasing voltage of the discharge power to be supplied to the electrodes 2 and 4. Thus, the discharge path divides into two after the luminous discharge of the first lamp $P_1$. The illumination region of these discharge lamps gradually extends, displaying the arrow dynamically.

When, as shown in FIG. 10(*b*), each of the pulse signals that compose the control signal to be supplied to the discharge lamp P or P' has a width shorter than the pulse width t in FIG. 10(*a*), the luminance obtained by luminous discharge of the discharge lamp P or P' is decreased to save energy. On the contrary when, as shown in FIG. 10(*c*), the pulse width is extended or the duty ratio is raised, the luminance obtained by luminous discharge of the discharge lamp P or P' can be increased.

Furthermore, when, as shown in FIG. 11(*b*), the control signal having a period shorter than $T_1$ in FIG. 11(*a*) is supplied to the discharge lamp P or P', the illumination region of the discharge lamp P or P' is variably controlled in a shorter period of time. On the other hand, when the control signal repetition period is extended, the illumination region can be varied to get dynamic change of the discharge path in a prolonged period of time.

In the above embodiments, the control signal to be applied to the discharge lamp P or P' continuously increases at the peak point of the pulse signal, as shown in FIG. 7(*c*), but it may be, for example, a triangular pulse as shown in FIG. 16(*c*) which continuously increases and then decreases at the peak point in a given period of time. In such a case, the illumination region obtained by luminous discharge of the discharge lamp P or P' continuously increases and then decreases in response to the control signal. Accordingly, the discharge path expands and then contracts in the period of $T_1'$, changing the information to be displayed in a mode different from the one by the control signal in FIG. 7(*c*).

When the discharge lamp P'' shown in FIG. 17 is connected to the circuit in FIG. 5, the illumination region of the discharge lamp P'' varies with the level of the voltage applied across the electrodes 17 and 18. In case the voltage level changes as shown in FIG. 7(*c*), the illumination region of the discharge lamp P'' continuously increases in the direction of the arrow in FIG. 17 along which the electrodes 17 and 18 become further apart from each other, and also the illumination region of the discharge lamp in FIG. 18 continuously increases in the direction of the arrow in FIG. 18 in each of the sections defined at desired intervals in the longitudinal direction of the tube. When the voltage level varies as shown by in FIG. 16(*c*), the illumination region of the discharge lamp in FIGS. 17 or 18 continuously increases and decreases in the same way as the discharge lamp P or P'.

As mentioned above, in the display device according to the present invention, the illumination region of the discharge lamp is variably controlled by increasing and decreasing the voltage level of the discharge power to be supplied to the electrodes of the discharge lamp, while creating dynamic effect on the discharge lamp itself, which feature is quite useful for various display control.

The electrodes of the discharge lamp are capacitively coupled and hence, the electric field intensity may be gradually varied with the distance between the electrodes by also increasing or decreasing the frequency of the driving signal to be supplied to the electrodes. According to the data of experiments, when the frequency of the driving signal to be supplied to the electrodes of the discharge lamp P in FIGS. 1 or 2 is changed continuously between 1 and 30 kHz, almost the same operational effect can be obtained as the one by the continuous change in the voltage level between 500 and 1200 V at the peak point.

In the above embodiments, pulse signals are used for control signals to energize the discharge lamp. Such pulse signals may be changed from rectangular pulse signal in FIG. 10 to triangular or sine waveform signal, so far as it has a frequency range from several to tens kHz. Also, the control signal may be changed from sawtooth waveform signal in FIG. 11 or triangular waveform signal in FIG. 16 to others, such as trapezoidal waveform signal.

While the invention has been described with reference to a few preferred embodiments thereof, it may be understood that modifications or variations may be easily made without departing from the scope of this invention which is defined by the appended claims.

What is claimed is:

1. A discharge lamp type display device, comprising, in combination:

(a) at least one discharge lamp, including, in combination:

(1) a discharge tube constructed from a dielectric material; and (2) a pair of electrodes disposed within the discharge tube, the tube being elongated and having a pair of spaced ends, an exterior surface being formed between the ends of the tube, one of the said electrodes being a projecting electrode extending longitudinally into the tube from and terminating adjacent to a respective one of the ends of the tube, and the other of the electrodes being a film of electrically conductive, light transmissive material deposited on the exterior surface of the tube and covering all of the exterior surface of the tube only from adjacent the projecting electrode to the other of the end of the tube; and (b) power supply means connected to at least one of the pair of electrodes for applying a driving signal across the electrodes, and including adjusting means for selectively varying the voltage and frequency of the driving signal and variably controlling a region of the tube which is illustrated to sweep from the one end of the discharge tube to the other of the ends thereof.

* * * * *